US005557158A

United States Patent [19]

Kanao et al.

[11] Patent Number: 5,557,158

[45] Date of Patent: Sep. 17, 1996

[54] SPARK PLUG AND METHOD OF PRODUCING THE SAME

[75] Inventors: Keiji Kanao, Okazaki; Kozo Takamura, Nagoya, both of Japan

[73] Assignee: Nippondenso Co., Ltd., Kariya, Japan

[21] Appl. No.: 260,792

[22] Filed: Jun. 16, 1994

[30] Foreign Application Priority Data

| | | | |
|---|---|---|---|
| Jun. 16, 1993 | [JP] | Japan | 5-145064 |
| Jul. 14, 1993 | [JP] | Japan | 5-174059 |
| Mar. 22, 1994 | [JP] | Japan | 6-050154 |

[51] Int. Cl.[6] ..... H01T 13/20; H01T 13/22; H01J 13/56

[52] U.S. Cl. ..... 313/141; 313/142; 313/144; 313/169; 313/139

[58] Field of Search ..... 313/141, 139, 313/142, 144; 123/169 R, 169 EL

[56] References Cited

U.S. PATENT DOCUMENTS

| | | | |
|---|---|---|---|
| 1,657,599 | 1/1928 | Yeker | 313/139 |
| 3,958,144 | 5/1976 | Franks | 313/141 |
| 4,705,486 | 11/1987 | Myers et al. . | |
| 4,725,254 | 2/1988 | Moore et al. . | |

FOREIGN PATENT DOCUMENTS

| | | |
|---|---|---|
| 56-45265 | 10/1981 | Japan . |
| 62-31797 | 7/1987 | Japan . |
| 4-92383 | 3/1992 | Japan . |
| 5-129063 | 5/1993 | Japan . |

*Primary Examiner*—Sandra L. O'Shea
*Assistant Examiner*—John Ning
*Attorney, Agent, or Firm*—Cushman, Darby & Cushman

[57] ABSTRACT

A spark plug which realizes reliability against thermal stress even in a case where dissimilar noble metal materials are disposed on the tip portion of the center electrode opposing the ground electrode and which realizes improved productivity while assuring durable reliability. The spark plug includes a center electrode electrically insulated from a housing and having a small-diameter portion at a tip portion which has a diameter smaller than that of a main body of the center electrode and composed of similar kinds of material as the center electrode, and a round-shape material, which is formed into a cylindrical or a ring shape, composed of dissimilar metal material. The round-shape material is fitted to the small-diameter portion of the center electrode so as to form a minute clearance between an inner surface of the round-shape material and is fixed to the center electrode by a large diameter portion which is integrally formed on a tip portion of the center electrode such that the minute clearance is kept between the round-shape material and the center electrode.

6 Claims, 17 Drawing Sheets

FIG.2B FIG.2D
FIG.2A FIG.2C FIG.2E
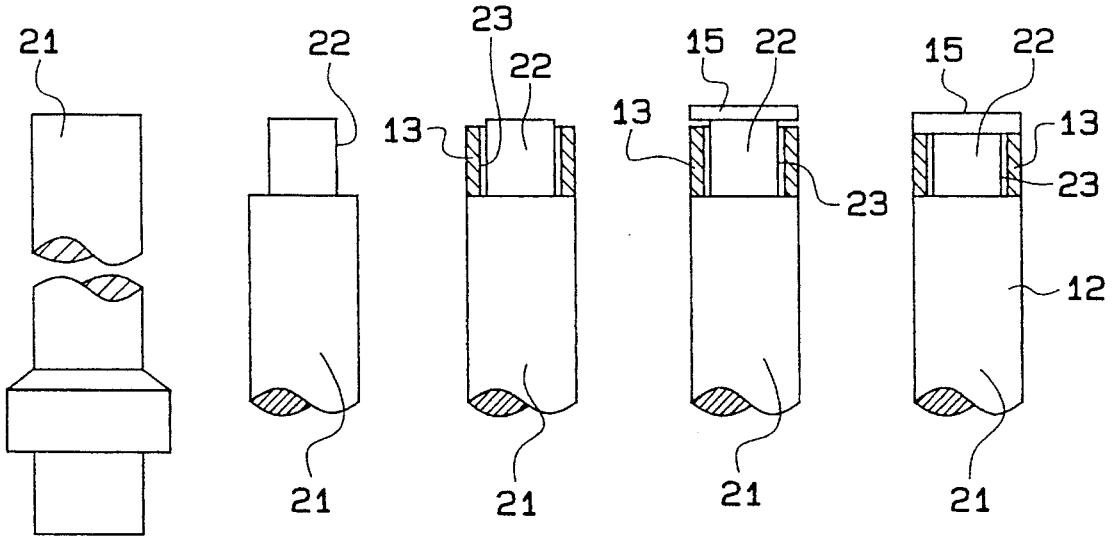
FIG.3A FIG.3B
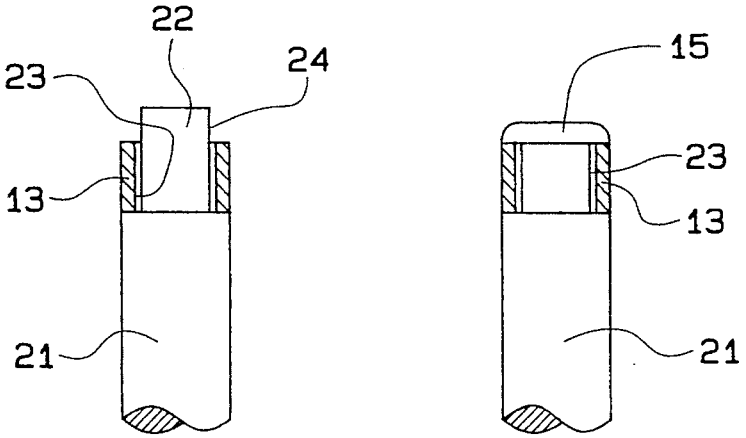

SPARK PLUG AND METHOD OF PRODUCING THE SAME

BACKGROUND OFT HE INVENTION

1. Field of the Invention

The present invention relates to a spark plug having a center electrode which forms a spark discharge gap between itself and a ground electrode, and more particularly to a spark plug used for an internal combustion engine wherein a discharge gap portion of a center electrode is provided with a dissimilar metal material of noble metals or the like, and a method of producing the same.

2. Description of the Related Art

More energy saving of the internal combustion engine used for vehicles such as automobiles is demanded in view of environmental protection and effective use of natural sources. For instance, a low fuel consumption is demanded, and development has progressed in this direction. A high compression system as well as a lean mixture combustion system using leaner mixture apparatus is developed as a possible method therefor. To progress the leaner mixture, the sparking voltage in the spark discharge gap becomes large.

Such sparking voltage further increases because of the enlargement of the discharge gap due to the consumption of the electrode, and it is likely that the withstand voltage margin is reduced and a spark discharge at areas other than the discharge gap is caused, thereby inflicting unnecessary damage on the internal combustion engine. In order to avoid such problems, there is demand for a spark plug having an electrode portion forming a discharge gap which is provided with a dissimilar metal material of noble metals or the like with efficient consumption resistance.

In response to such demand, many spark plugs of a structure in which precious metal material is disposed in the discharge spark gap portion have been proposed (for example, Japanese examined patent publication Nos. 56-45265 and 62-31797).

In the Japanese examined patent publication No. 56-45265, a noble metal ring 252 is press-fitted to a small-diameter portion on the tip portion of the center electrode 251 as shown in FIG. 17*a*, then the center electrode 251 and the noble metal ring 252 are adhered and fixed to each other as shown in FIG. 17*b*.

In the Japanese examined patent publication No. 62-31797, as shown in FIG. 19A, a coaxial projection of reduced diameter is formed on a tip surface of a center electrode 261, a noble metal ring 262 and formed with a hole into which the projection fits is placed on a tip surface of the center portion, and this ring 262 is fixed to the tip surface of the center electrode 261 by welding. In this case, the outer diameter of the noble metal ring 262 which is secured by welding is formed by extruding with dies 263, and this noble metal ring 262 is deformed so as to surround the side outer surface on the tip portion of the center electrode 261.

According to the above structure of the spark plug which is produced simply by swaging after the noble metal ring 252 is press-fitted to the small-diameter portion, as the noble metal ring 252 is applied pressure innerwardly in the radial direction, the noble metal ring 252 is reduced in the diameter while being stretched in the axial direction. However, as an axial deformation of the top end portion 253 of the noble metal ring 252 is not restricted, the top end portion 253 is stretched greater than the other portion. Thus, the portion around the top end portion 53 forms a thin portion 254 as shown in FIG. 17B.

In case that such center electrode 251 is exposed to heating and cooling environment of the combustion chamber of the engine, as the center electrode 251 and the noble metal ring 252 have different coefficients of linear expansion, the thermal stress is caused due to the difference of the coefficients of the linear expansion. This thermal stress becomes remarkably large around the top end portion 54 of the noble metal ring 252 due to the thin thickness thereof, and the crack 255 is advanced as shown in FIG. 19. By this crack 255, the noble metal ring 252 is dislodged, or exfoliated, and there is a possibility that the gap may be bridged.

According to the structure of the spark plug which is produced by extruding after the noble metal ring is welded to the tip portion of the center electrode, the drawing and extruding by the dies 263 is proceeded with high friction between the surface of the center electrode and the surface of the dies. Accordingly, the surface of the noble metal ring 262 is largely stretched by the dies 263 with high friction. As a result, the bottom portion 263 of the noble metal ring 262 is formed in a extreme thinning shape. In case that the center electrode 261 is exposed to the heating and cooling environment of the combustion chamber of the engine, as described the above, the crack 264 is advanced from the bottom end portion 263 as shown in FIG. 20.

Especially, the noble metal ring 262 welded to the tip surface of the center electrode 261 is extruded in the producing, the noble metal ring 262 and the material forming the center electrode 261 in the center position have different ductilities. Consequently, difference of deformation resistances is caused, and in the case of axial stretching, it is impossible to maintain the thickness of the precious metal material in a uniform condition over the entire area, and further the dimension in the axial stretching lacks stability. This appears markedly when the contraction percentage (surface-reduction rate) become high. Consequently, the dimensions of the center electrode is restricted, and it becomes necessary that the noble metal portion of the side surface of the center electrode opposing the ground electrode is disposed over a wide area in view of the above problem.

Additionally, when producing a spark plug of such structure, the noble metal ring 262 is adhered to the center electrode 261 by welding and further extruding, and so the interface of the noble metal ring 262 and the center electrode 261 adhered thereto repeatedly sustains thermal stress due to temperature changes owing to combustion and to the difference in the coefficients of linear expansion owing to the dissimilarity of the materials.

In order to prevent fracture due to radial thermal stress, material thickness to ensure the thermal stress intensity which is acted upon becomes necessary, and it is also necessary to ensure the uniformity of the thickness in order to prevent the generation of concentrated stress.

When generating spark discharge in the spark plug, consumption occurs on the electrodes which form the discharge gap where the discharge is generated. The tip portion of the center electrode 261 opposing the ground electrode is most consumed, because the tip portion of the center electrode 261 is directly exposed to high temperature due to combustion, in addition to the spark consumption. Consequently, the tip portion of the electrode is transformed into a tapered shape in a short time. When such consumption due to spark discharge is taken into account as well, considerable thickness comes to be demanded for the noble metal material, which also detracts from economy.

Furthermore, stress oxidation due to radial stress advances on the interface of the center electrode 261 and noble metal ring 262. Consequently, there is a possibility that the noble metal ring 262 may be dislodged by thermal shock or vibration with long-term use and the gap may be dislodged.

SUMMARY OF THE INVENTION

In view of the above problem, an object of the present invention is to provide a spark plug for an internal combustion engine which dependably obtains reliability against thermal stress even in a case that dissimilar metal materials of noble metals or the like are disposed on the tip portion of the center electrode opposing the ground electrode, as well as improving productivity in the production thereof while assuring durable reliability, and a method of producing the same.

According to the first aspect of the present invention, a spark plug comprises a center electrode electrically insulated from a housing and having a small-diameter portion at a tip portion which has a diameter smaller than that of a main body of the center electrode and composed of the similar kinds of material as the center electrode, a round-shape material, which is formed into a cylindrical or a ring shape, composed of dissimilar metal material and fitted to the small-diameter portion of the center electrode so as to form a minute clearance between an inner surface of the round-shape material and an outer surface of the small-diameter portion of the center electrode, and a ground electrode opposing to the center electrode so as to form a spark gap therebetween, wherein the round-shape material is fixed to the center electrode by a large diameter portion which is integrally formed on a tip portion of the center electrode such that the minute clearance is kept between said round-shape material and the center electrode.

According to the second aspect of the invention, a method of producing a spark plug having a center electrode and a round-shape material composed of dissimilar metal material fixed to said center electrode, comprises steps of forming a small-diameter portion formed in a cylindrical shape on a tip portion of the center electrode, fitting the round-shape material to the small-diameter portion such that a minute gap is formed between an inner surface of the round shape material and an outer surface of the center electrode; and processing a large-diameter portion on the small-diameter portion, thereby the round-shape material being fixed to the center electrode so as to form the minute clearance.

BRIEF DESCRIPTION OF THE DRAWINGS

In the accompanying drawings:

FIG. 1A is a plan view and FIG. 1B is a partial cutaway side view;

FIGS. 2A to 2E show sequentially a producing process of a center electrode of the embodiment;

FIGS. 3A and 3B show another producing process of the embodiment;

FIG. 8A is a side view, and FIG. 8B is a cross sectional view taken along the line VIII B—VIII B;

DETAILED DESCRIPTION OF THE PREFERRED EMBODIMENTS

Figure 1A:
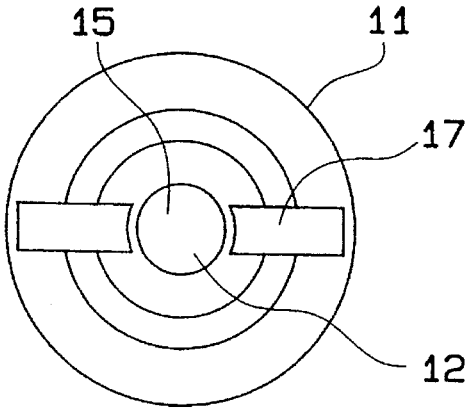
FIGS. 1A and 1B show a spark plug according to an embodiment of the present invention.
Figure 1B:
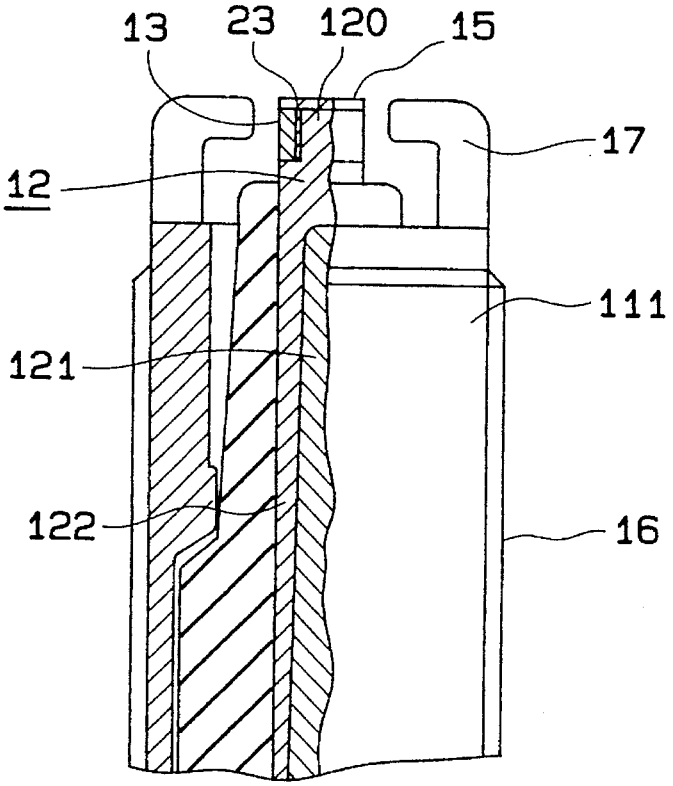

An embodiment of the present invention is described below with reference to the drawings. FIGS. 1A and 1B are enlarged views of an igniting portion of a spark plug used for an internal combustion engine according to the embodiment. A center electrode 12 is provided so as to correspond to the center axis of a housing 11. The center electrode 12 comprises a core material 121 composed of copper, and nickel alloy 122 (for example, 93 wt % nickel, 2% chrome, 3% manganese, and 2 silicon) disposed so as to cover the surface of this core material 121. A noble metal material 13 formed in a cylindrical shape is disposed on and fitted with the tip portion of this center electrode 12, and the center electrode 12 thus formed is fitted into the interior of an insulating glass 14.

The noble metal material 13 disposed on and fitted into the tip portion of this center electrode 12 may be composed of platinum, platinum-iridium, platinum-tungsten, platinum-rhodium, platinum-palladium, platinum-nickel, gold-palladium, or an alloy thereof, which is rolled into a cylinder having a thickness of 0.2 to 0.4 mm, an outer diameter of 2.5 mm, a length dimension of 2 mm, and an inner diameter of 1.7 to 2.1 mm.

The cylindrical noble metal material 13 is disposed on and fitted with a protruding electrode 120 formed by reducing the outer diameter of the tip portion of the center electrode 12, and is mechanically fixed to the tip surface of the center electrode 12 corresponding to the tip portion of the noble metal material 13 by welding a stopper material 15 composed of the same kinds of material as the center electrode 12 or the noble metal material 13, thereby preventing dislodgement of the noble metal material 13 due to advancing oxidation of the center electrode tip as well as decrease in fixing function due to spark consumption. The stopper material 15 is formed in a cylindrical shape and composed of the same or the similar metal material as the center electrode 12 or the noble metal material with, for example, a thickness of 0.2 to 0.4 mm and an outer diameter of 2.5 mm.

A thread groove 16 is formed on the outer periphery of the housing 11 for being mounted on a cylinder of the internal combustion engine. A ground electrode 17 which is connected to the ground when mounted on an engine by the thread groove 16 is provided integrally with the housing 11. In this case, the ground electrode 17 is disposed so as to closely oppose the side surface of the center electrode 12, particularly the noble metal material 13, thereby forming a predetermined gap for spark discharge.

FIGS. 2A–E show sequentially the manufacturing process of the center electrode 12 for the spark plug. The center electrode 12 is comprised on the basis of an electrode body 21 formed in a cylindrical shape (shown in FIG. 2A) by machining with a predetermined dimension so as to fit in an accommodating portion formed in the center shaft of the insulating glass 14.

As shown in FIG. 2B, a small-diameter portion 22 having a diameter smaller than the diameter of the body is formed on the electrode body 21. As shown in FIG. 2C, a noble metal material 13 formed in a cylindrical shape is fitted so as to oppose this small-diameter portion 22. This small-diameter portion 22 constitutes the protruding electrode portion, and the inner diameter of the noble metal material 13 is set to be slightly larger than the outer diameter of the small-diameter portion 22, thereby forming a minute clearance 23 of approximately 0.1 mm between the outer peripheral surface of the small-diameter portion 22 and the inner peripheral surface of the noble metal material 13. The length of the small-diameter portion 22 of the electrode body 21 is made to be slightly longer than the axial length of this cylindrical noble metal material 13. When the noble metal material 13 is fitted into the small-diameter portion 22, the tip portion of the small-diameter portion 22 of the center electrode body 21 protrudes slightly beyond the tip portion of the noble metal material 13. The amount of protrusion is determined to be approximately 0.2 to 0.5 mm.

After the noble metal material 13 is fitted into the center electrode body 21 in such a manner, a stopper material 15 formed in a cylindrical shape and composed of the same kinds of material as the center electrode 12 or the noble metal material is disposed on the tip surface of the small-diameter portion 22 of the center electrode body 21 as shown in FIG. 2D. The clearance between the stopper material 15 and the tip of the small-diameter portion 22 of the center electrode body 21 is bonded integrally by resistance welding or the like, thereby completing the center electrode 12 as shown in FIG. 2E.

If the metals constituting the center electrode body 21 and stopper material 15 are composed of same material, the stopper material 15 has a lower melting point than the material of the noble metal material 13. Accordingly, there is no thermal deformation when the stopper material 15 is bonded to the center electrode body 21 by welding. Moreover, if the stopper material 15 is composed of the same material as the noble metal material 13, the melting point of the stopper material is higher than for the center electrode 12. For this reason, thermal deformation on the bond surface due to supply of electric current and pressurization during resistance welding is limited to the extent that the protrusion of the small-diameter portion 22 is deformed at a slight amount and contacts the inner side of the tip of the noble metal material 13. Accordingly, the minute clearance 23 formed between the outer peripheral surface of the small-diameter portion 22 of the center electrode body 21 and the inner peripheral surface of the noble metal material 13 is maintained even after welding the stopper material 15.

In the case that the stopper material 15 is composed of the same kinds of material as the center electrode, the stopper material 15 can be easily formed, for example, without bonding a cylindrical separate material. FIGS. 3A and 3B show a modification of the embodiment for the production of the center electrode 12. First, as shown in FIG. 3A, a small-diameter portion 22 is formed on the tip of the center electrode body 21. Then, in same way of the above-described embodiment, a cylindrical noble metal material 13 is fitted so as to directly oppose this small-diameter portion 22. The outer diameter of the small-diameter portion 22 and the inner diameter of the cylindrical portion of the noble metal material 13 are disposed so as to form a minute clearance 23 between the inner peripheral surface of this noble metal material 13 and the outer peripheral surface of the small-diameter portion 22.

In this case, when the noble metal material 13 is fitted into the small-diameter portion 22 of the center electrode body 21, the dimensions are determined such that the tip portion of the small-diameter portion 22 has a protrusion which protrudes approximately 1 to 2 mm beyond the tip surface of the noble metal material 13. Although not shown in detail, the end face of the protrusion 24 is made to contact a welding electrode when pressing is proceeded together with heating by the supply of electric current, thereby causing heat deformation and forming the stopper material 15 as shown in FIG. 3B. That is to say, the noble metal material 13 is maintained mechanically attached to the tip of the center electrode body 21 by stopper material 15. In this case as well, a minute clearance 23 is formed between the outer peripheral surface of the small-diameter portion 22 and the inner peripheral surface of the noble metal material 13.

According to the above embodiments, a small-diameter portion is formed on the tip portion of a center electrode body, a cylindrical noble metal material is fitted to the small-diameter portion, and dislodgement of the noble metal material from the small-diameter portion is prevented by means of a stopper material. However, it is not limited to such structure, there are various kinds of structure such that a cylindrical noble metal material is fixed to a center electrode body so as to form a minute clearance is established. Modifications of such structures as well as the methods of producing the same are described below.

Figure 4A:
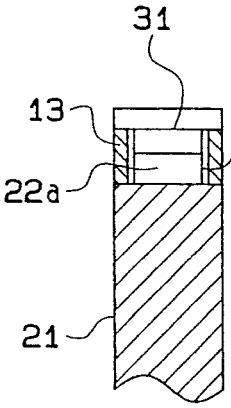
FIGS. 4A to 4D are cross sectional views showing modifications of the embodiment.

In an embodiment shown in FIG. 4A, a small-diameter portion 221 is formed so that a cylindrical noble metal material 13 is fitted to the tip of a center electrode body 21. The axial length of this small-diameter portion **22*a* is smaller than that of the noble metal material 13. After the noble metal material 13 is fitted into the small-diameter portion 22*a*, the center electrode body 21 and a rivet material 31 are fitted together from the direction of the tip, the contact portion between this rivet material 31 and the tip of the small-diameter portion 22*a* is bonded by means of resistance welding or the like, and the noble metal material 13 is attached so as to form a minute clearance 23 with the center electrode body 21**.

Figure 4B:
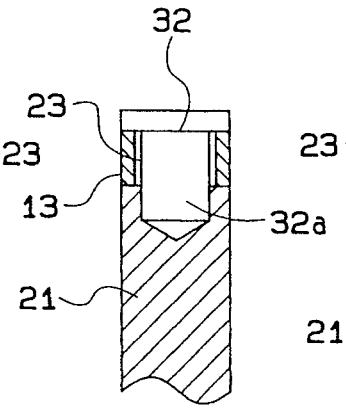

In an embodiment shown in FIG. 4B, a noble metal material 13 is disposed coaxially on the tip surface of a cylindrical center electrode body 21, a rivet material 32 is inserted from the direction of the tip of the noble metal material 13, and the tip portion of this rivet material 32 is fitted to the tip surface of the center electrode body 21 and integrally connected by resistance welding or the like. This rivet material 32 is composed of the same material as the center electrode body 21.

In this embodiment, a body portion 32*a* of the rivet material 32 performs the same functions as the small-diameter portion 22 of the embodiments described heretofore. A minute clearance 23 is formed between the outer peripheral portion of this body portion 32*a* and the inner periphery of the noble metal material 13.

Figure 4C:
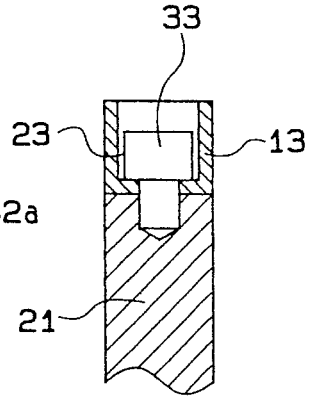

In an embodiment shown in FIG. 4C, the noble metal material 13 is formed in a cup shape, and the cup-shaped bottom surface is in contact with the tip surface of the cylindrical center electrode body 21. In this embodiment, a through-hole is formed in the center axial portion of the cup-shaped bottom surface of the noble metal material 13, and a rivet material 33 is punched into the tip surface of the electrode body 21 from the opening of the body portion of the noble metal material 13 through the through-hole. Both are integrally connected by means of resistance welding or the like, thereby fitting the noble metal material 13 to the center electrode. A minute clearance 23 is formed between the outer periphery of the rivet material 33 and the inner periphery of the noble metal material 13.

Figure 4D:
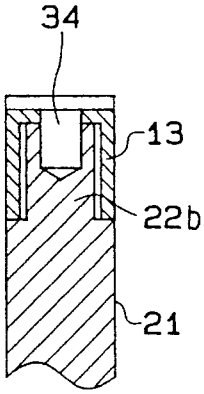

In the embodiment shown in FIG. 4D, a small-diameter portion 22*b* is formed on the tip of the center electrode body 21. A noble metal material 13 formed into a cup shape is disposed so as to cover this small-diameter portion 22*b*. That is to say, the copper portion of the noble metal material 13 formed in a cup shape covers the outer periphery of the small-diameter portion 22*b*, and the inner surface of the bottom surface covers the tip surface of the small-diameter portion 22*b*. A through-hole is formed on the axis of the bottom surface, and this noble metal material is attached to the top of the small-diameter portion 22*b* of the center electrode body 21 by means of a rivet material 34.

Figure 5A:
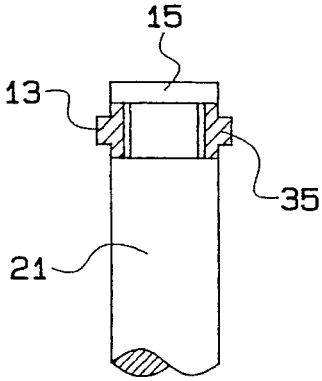
FIGS. 5A and 5B show a modification of fixing means for the noble metal material.
Figure 5B:
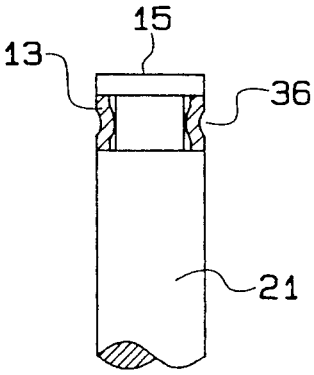

The noble metal material 13 is attached to the center electrode 12 in such a manner, but, as shown in FIG. 5A, it is also applicable to form a convex strip 35 on the outer periphery of the cylindrical metal material 13 and caulk this convex strip 35 as shown in FIG. 5B so as to form an concave portion 36. According to such structure, further reinforcement for preventing dislodgement of the noble metal material 13 is obtained.

In the foregoing embodiments, the noble metal material 13 is formed of a single piece. However, the number of the noble metal material 13 may be increased or decreased as required, and in case that the noble metal material is formed as a single cylindrical body, the load for producing the noble metal material 13 is increased, which causes higher costs. Additionally, as for the noble metal material has high hardness and low ductility, it may be occasionally difficult to process machining into a long cylindrical shape.

Figure 6A:
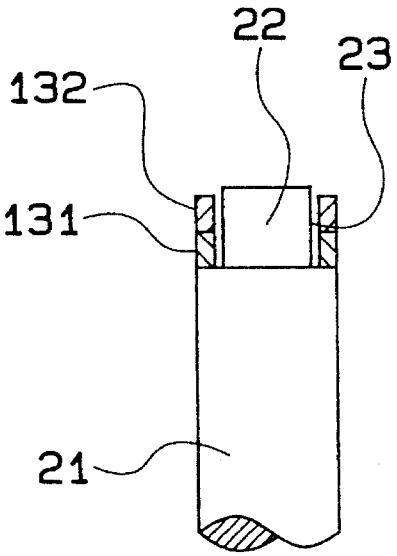
FIGS. 6A and FIG. 6B indicate a producing process of another embodiment, particularly of the noble metal material.
Figure 6B:
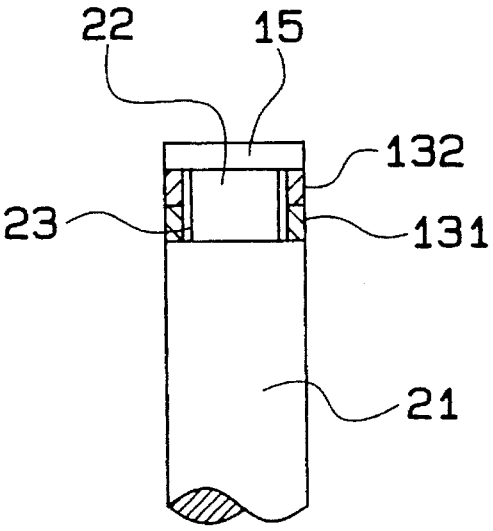

Modification of such structure is described in FIGS. 6A and 6B. First, as shown in FIG. 6A, a plurality of, for example, two noble metal materials 131 and 132 are fitted to the outer periphery of a small-diameter portion 22 formed at the tip portion of a center electrode body 21. These noble metal materials 131 and 132 are two ring-shaped materials to which correspond two divisional pieces of the cylindrical metal material 13 in the axial direction in the heretofore embodiment. These two noble metal materials 131 and 132 are piled one another, and obtain the same function as the noble metal material 13 in the foregoing embodiments.

Such ring-shaped noble metal materials 131 and 132 are formed by, for example, punching comparatively thin sheet material composed of a noble metal composition with a ring shape. A predetermined number of the noble metal materials are fixed by caulking a plurality of these to the outer periphery of the small-diameter portion 22. In this case, of course, the respective inner diameter of each noble metal material 131 and 132 is made to be slightly larger than the outer diameter of the small-diameter portion 22, and as shown in FIG. 6B these noble metal materials 131 and 132 which are axially piled are retained by means of a stopper material 15.

Next, another embodiment of the present invention is described below.

In this embodiment, the present invention is applied to a spark plug for an internal combustion engine.

Figure 7:
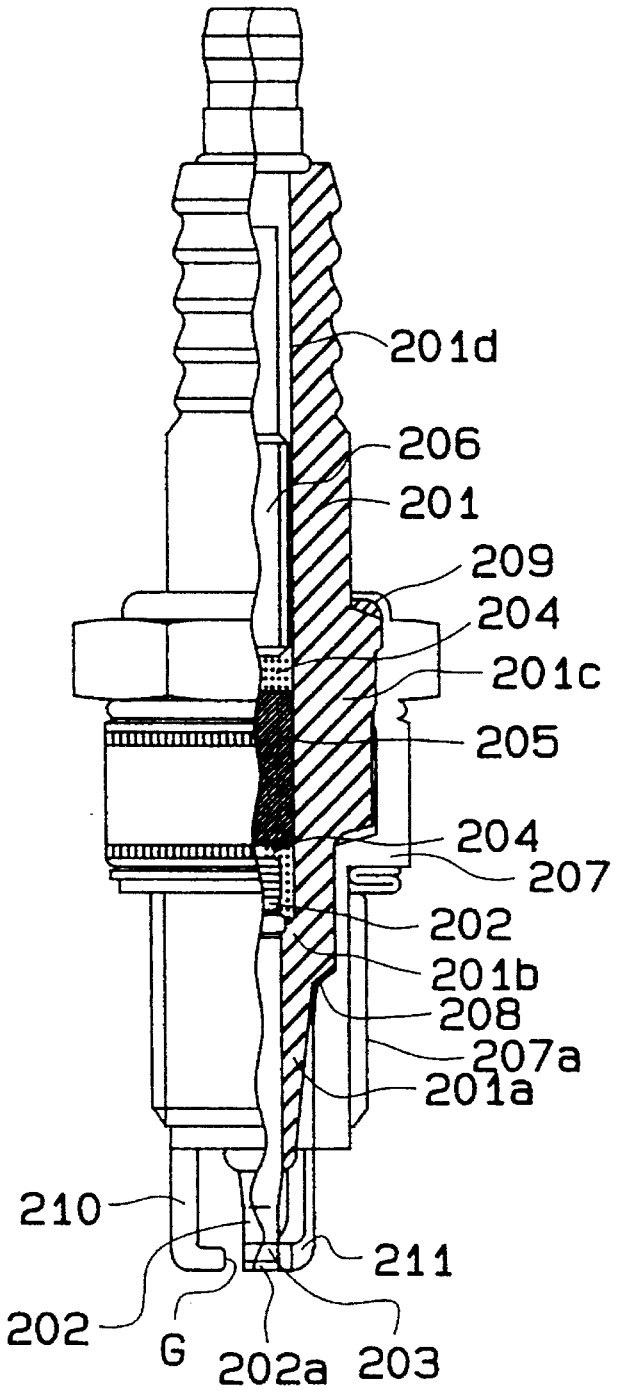
FIG. 7 is a partial sectional view showing an another embodiment of the present invention.
Figure 8A:
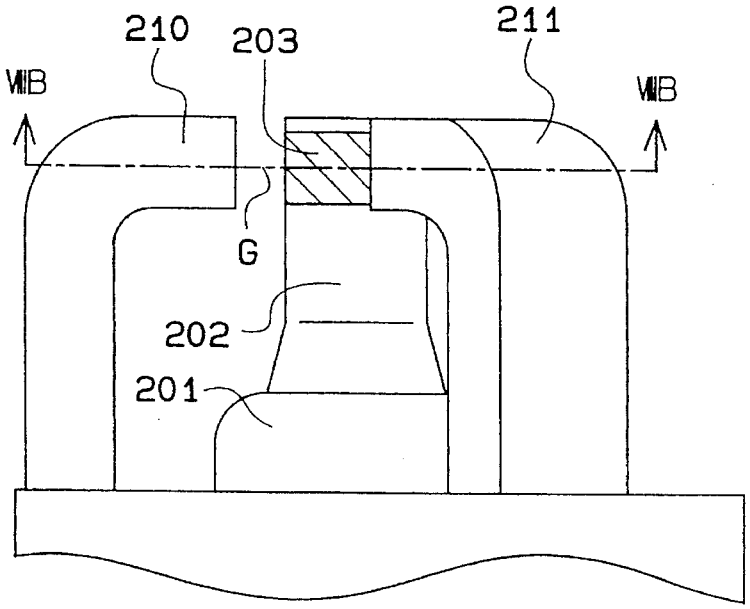
FIGS. 8A and 8B are enlarged views showing the ignition portion of the embodiment.
Figure 8B:
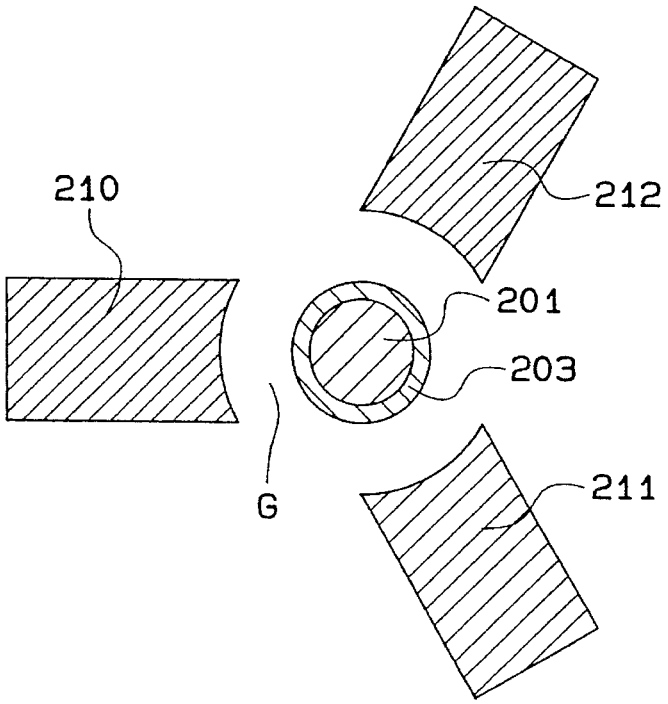

FIG. 7 is a partial sectional view showing a spark plug 200 of the embodiment. FIG. 8A is an enlarged view of the ignition portion, and FIG. 8B is a cross sectional view taken along line VIII B—VIII B of FIG. 8A.

In FIG. 7, an insulator 201 is formed from alumina porcelain. The electrode 201 has a leg portion 1*a* exposed to a combustion chamber (not shown), and the leg portion 201*a* is formed integrally with the main body 201*c* with a stepped portion 201*b* formed in a tapered shape. Additionally, a center hole 201*d* is axially provided, and a center electrode 202 composed of a nickel alloy is disposed in the center hole 201*d* at its combustion chamber side. A platinum ring 203 is disposed on one end 202*a* of this center electrode 202. Furthermore, a center axis 206 composed of carbon steel is electrically connected to the other end 202*b* of the center electrode 202 via conductive glass 204 and resistance powder 205. A metal housing 207 is formed in a generally cylindrical shape and formed of heat-resistant and corrosion-resistant metal, and the insulator 201 is fixed in the metal housing 207 via ring-shaped seal gaskets 208 and 209 to keep air tight. The housing 207 is provided with a thread portion 207*a* for being fixed to the cylinder block of the internal combustion engine, as well as ground electrodes 210, 211, and 212 on the center electrode 202 so as to form a spark gap G with platinum ring 203, as shown in FIGS. 8A and 8B.

Next, the method of producing the center electrode 202, which is a characteristic of this embodiment of the present invention, is described with reference to FIGS. 9A to 9D.

Figure 9A:
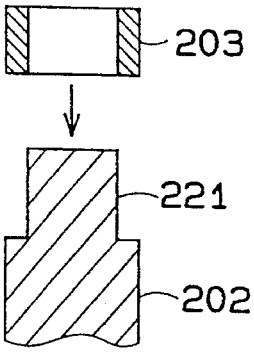
FIGS. 9A to FIG. 9E showing a method of producing of a center electrode in the embodiment.

First, the center electrode 202 is composed of a nickel-chromium-iron alloy (Inconel 600), and, as shown in FIG. 9A, the tip portion is formed into a small-diameter portion 221 by means of cutting or deformation processing. The small-diameter portion 221 has an outer diameter of 1.5 mm and an axial length of 1.5 mm. Also, although not shown in the drawing, the center electrode 202 has a core composed of copper in order to improve thermal conductivity.

Next, a platinum ring 203 composed of platinum alloy (80 wt % of platinum and 20 wt % of nickel) is fitted to the small-diameter portion 221 formed on the tip portion of the above center electrode 202. The platinum ring 203 is formed so as to have an inner diameter of 1.75 mm, an outer diameter of 2.5 mm, and an axial length of 1.0 mm.

Figure 9B:
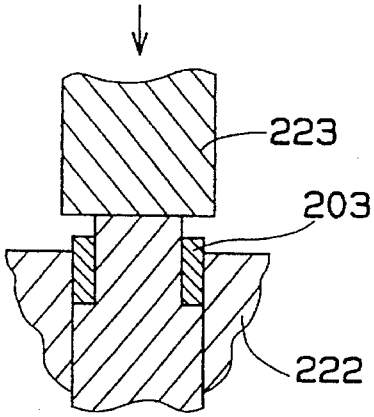
Figure 9C:
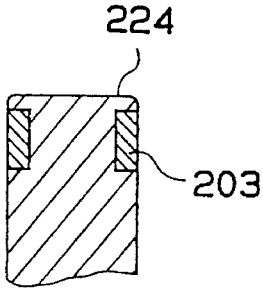

Subsequently, the center electrode 202 fitted to the platinum ring 203 is fixed to a jig 222 having a hole for fixing the center electrode, as shown in FIG. 9B. The small-diameter portion 221 of the center electrode 202 is then compressed by a punch 223. At this time, in order to make it easier to deform the tip portion of the small-diameter portion 221, electric current is supplied from the punch 223 to the center electrode 202 and the small-diameter portion 221 is heated. That is to say, a large-diameter portion 224 is formed at the tip portion of the small-diameter portion 221 as shown in FIG. 9C by compressing while heating. According to the above method, the top end and bottom end of the platinum ring 203 are fixed to the center electrode 202 and thereby being axially fixed.

Figure 9D:
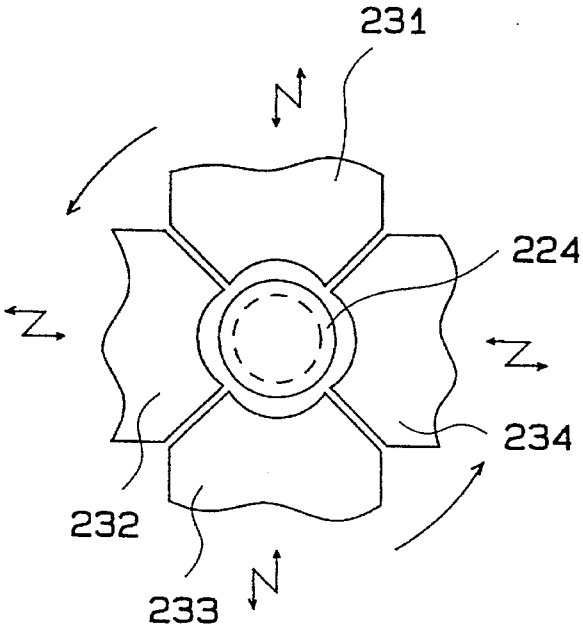

Furthermore, the outer diameter of the entire area including the large-diameter portion 224 of the center electrode fixed with the platinum ring 203 and the platinum ring 203 is reduced by swaging as shown in FIG. 9D, and the platinum ring 203 and center electrode 202 are adhered to each other. In swaging, tools 231, 232, 233, 234 strikes the surfaces of the center electrode 202 and platinum ring 203 while rotating, thereby processing the reduction of the diameter thereon. At this time, the large-diameter portion 212 restricts deformation of the tip portion of the platinum ring 203 in the axial direction.

By processing the reduction of the diameter, the area around the center electrode 202 including the platinum ring 203 is determined to have an outer diameter of 2.0 mm, an inner diameter of 1.4 mm, and an axial length of 1.5 mm.

Moreover, because the swaging reduces the diameter by applying pressure toward the center axis of the center electrode 202 fitted to the platinum ring 203, the platinum ring 203 and center electrode 202 are integrally stretched in the axial direction. Therefore, the center axis of the platinum ring 203 constantly corresponds to the center axis of the center electrode 202.

Figure 9E:
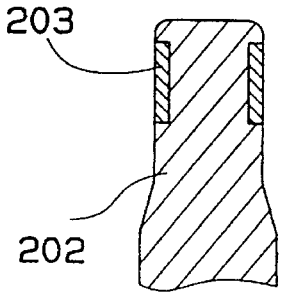

As described the above, as shown in FIG. 9E, the platinum ring 203 is adhered to and fixed to the center electrode 202 at a substantially uniform thickness regardless of the positions of the top end and bottom end. Additionally, the center axis of the platinum ring 203 constantly corresponds to the center axis of the center electrode 202. Consequently, it is hard that cracking due to thinning of the platinum ring occurs, and there is little possibility that bridging in the spark gap is caused.

Figure 17A:
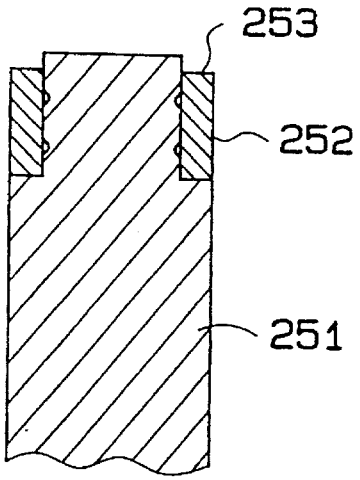
FIG. 17A PRIOR ART
FIGS. 17A and B are cross sectional views indicating a center electrode in the prior art.
Figure 17B:
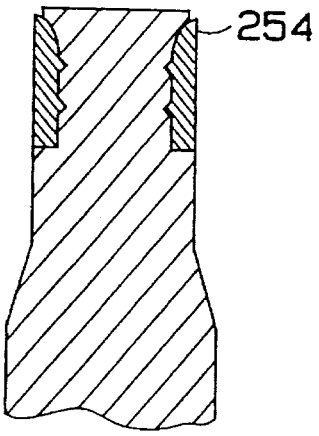
FIG. 17B PRIOR ART

Furthermore, according to the above producing method, the deformation of the platinum ring 203 at the top end is restricted by means of the large-diameter portion 212. For this reason, no thinning occurs at top end of the platinum ring 203, as shown in FIG. 17B.

Figure 19A:
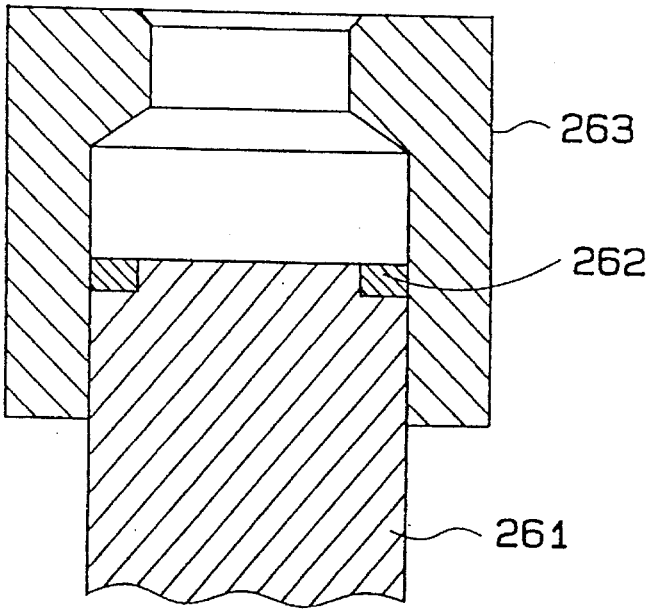
FIG. 19A PRIOR ART
FIGS. 19A and B are sectional views showing the center electrode in the prior art.
Figure 19B:
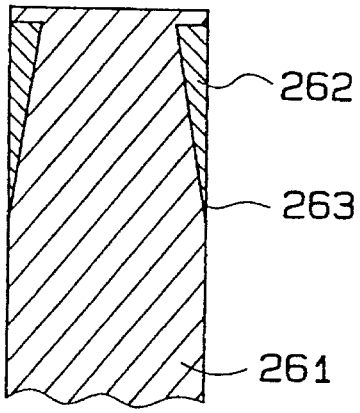
FIG. 19B PRIOR ART
Figure 20:
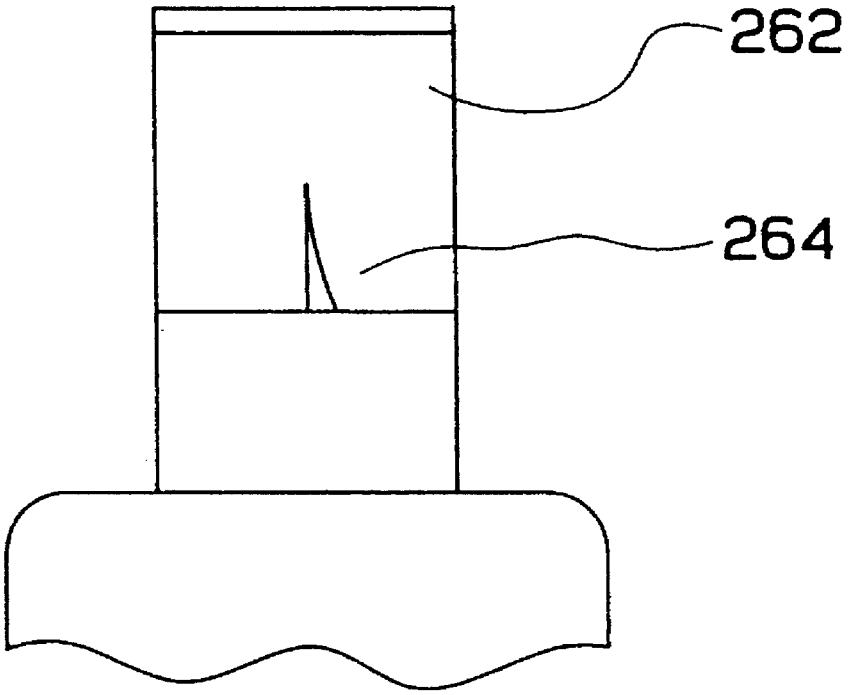
FIG. 20 PRIOR ART
FIG. 20 indicates a cracked condition of the center electrode in the prior art.

Additionally, the swaging reduces the diameter by striking the center electrode 202. Therefore, the friction between the center electrode 202 and platinum ring 203 on the one hand and the tools 231, 232, 233, and 234 on the other is extremely small. Consequently, the platinum ring 203 surface is not only largely stretched, no thinning occurs at the bottom end of the platinum ring 203, which is different from the prior art as shown in FIG. 19B.

Next, a spark plug 200 having the above structure is evaluated as to whether cracking occurs in the platinum ring 203 under conditions of heating and cooling in an engine combustion chamber.

The composition of the ring 203 used for the spark plug 200 is a platinum alloy with a weight ratio of nickel varied from 2% to 40%. Because the coefficient of linear expansion of the platinum alloy increases in accordance with the amount of nickel to the extent that the nickel is added, it approaches the coefficient of linear expansion of the nickel-chromium-iron alloy which is the electrode material of the center electrode 202.

Accordingly, center electrodes disposed with platinum rings were prepared as two comparative examples. The first comparative example was produced by swaging after a noble metal ring had been simply press-fitted to the small-diameter portion of a center electrode, and second comparative example was produced by extruding after the noble metal ring had been welded to the tip portion of the center electrode. The dimensions of the platinum-alloy ring at this time were made to be an outer diameter of 2.0 mm, an inner diameter of 1.4 mm as an average including the thin portion, and an axial length of 1.5 mm. Next, this electrode was incorporated into a spark plug in the same way of the foregoing embodiment.

As for the evaluation, heating and cooling loads of an engine were applied to spark plugs according to the embodiment of the present invention, first comparative example, and second comparative example as manufactured above. The operating conditions of the engine were total operating time of 100 hours, in which idling of 1 minute and 1 minute at a full load of 5,000 rpm were repeated. In this test, a water-cooled, 6-cylinder, 4-cycle engine with a piston displacement of 2,000 cc was used.

Figure 10:
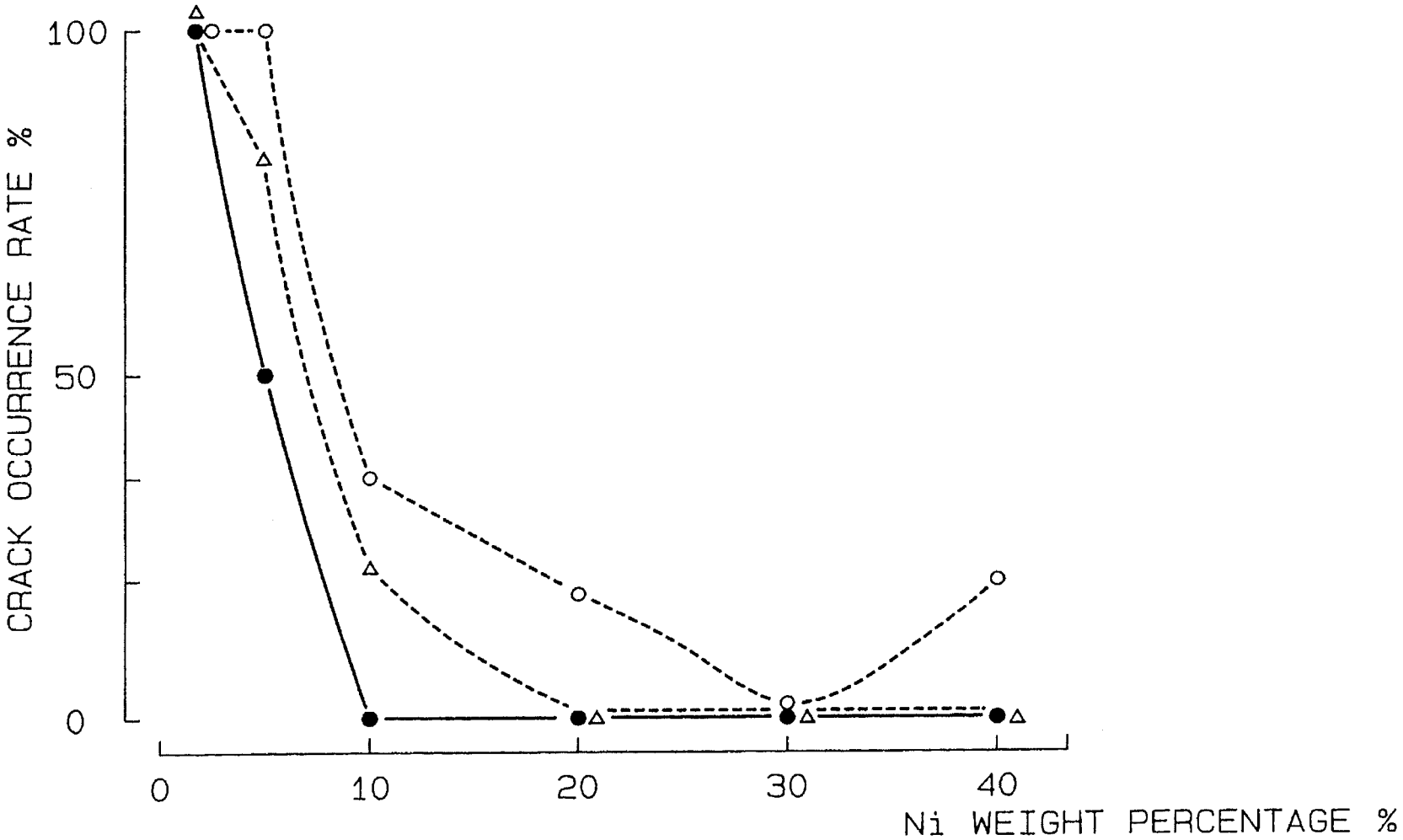
FIG. 10 is a characteristic diagram indicating conditions of occurrence of cracking in the center electrodes according to the embodiment and comparative examples.

FIG. 10 is a characteristic diagram showing the conditions of crack occurrence after 100 hours of the operation.

The axis of ordinates the crack occurrence rate, and indicates a value equal to the number of plug in which cracking occurred in the platinum-alloy ring divided by the number of plugs tested. The axis of abscissa indicates the weight percentage of the amount of nickel added. In FIG. 10, the "●" symbol indicates a characteristics of a spark plug 100 according to the present embodiment, the "○" symbol indicates a characteristics of a plug according to the first comparative example, and the "Δ" symbol indicates a characteristics plug according to the second comparative example.

Figure 18:
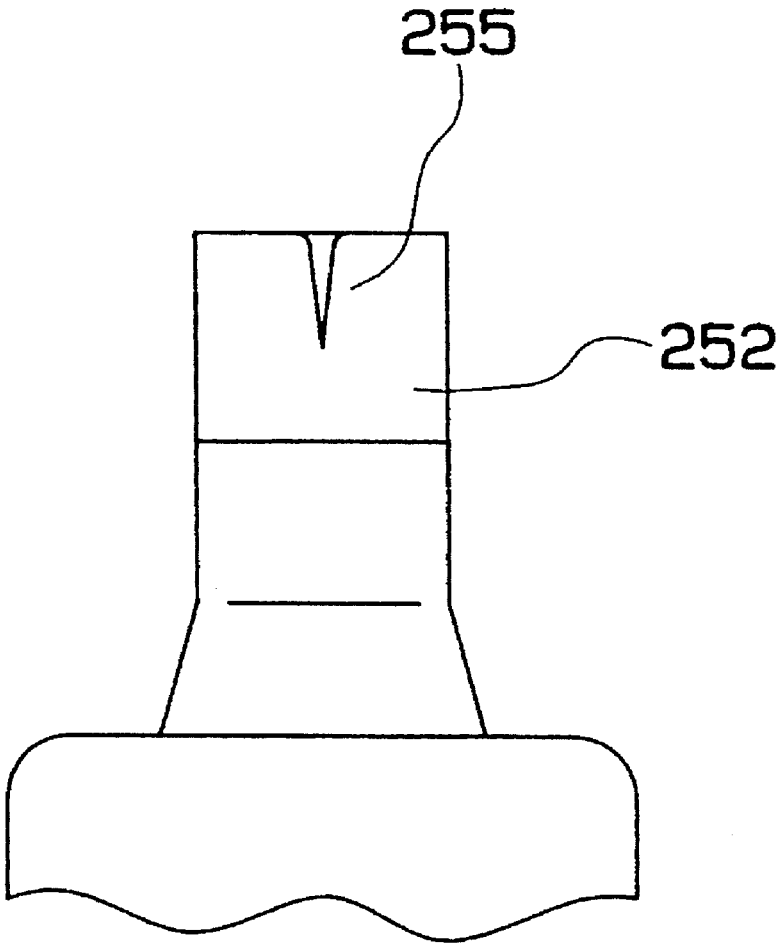
FIG. 18 PRIOR ART
FIG. 18 shows a cracked condition of the center electrode in the prior art.

As shown in FIG. 10, with the first comparative example, no cracking of the platinum-alloy ring occurred in case that the nickel addition amount is 30%. However, in case that the nickel addition amount is other than 30%, cracking occurred in the thin portion of the top end of the platinum-alloy ring, as shown in FIG. 18.

Additionally, with the second comparative example, no cracking of the platinum-alloy ring occurred in case that a nickel addition amount is 20% or more. However, in case that a nickel addition amount is less than 20%, cracking occurred in the thin portion of the top end of the platinum-alloy ring, as shown in FIG. 18.

However, with a spark plug 200 according to the present embodiment, no cracking occurred in case that the nickel addition amount is 10% or more. That is to say, it is possible to use a platinum-alloy material with a smaller range of nickel addition than the first or second comparative example.

Next, the preferability of a low nickel addition amount in the platinum-alloy material is described.

Figure 11:
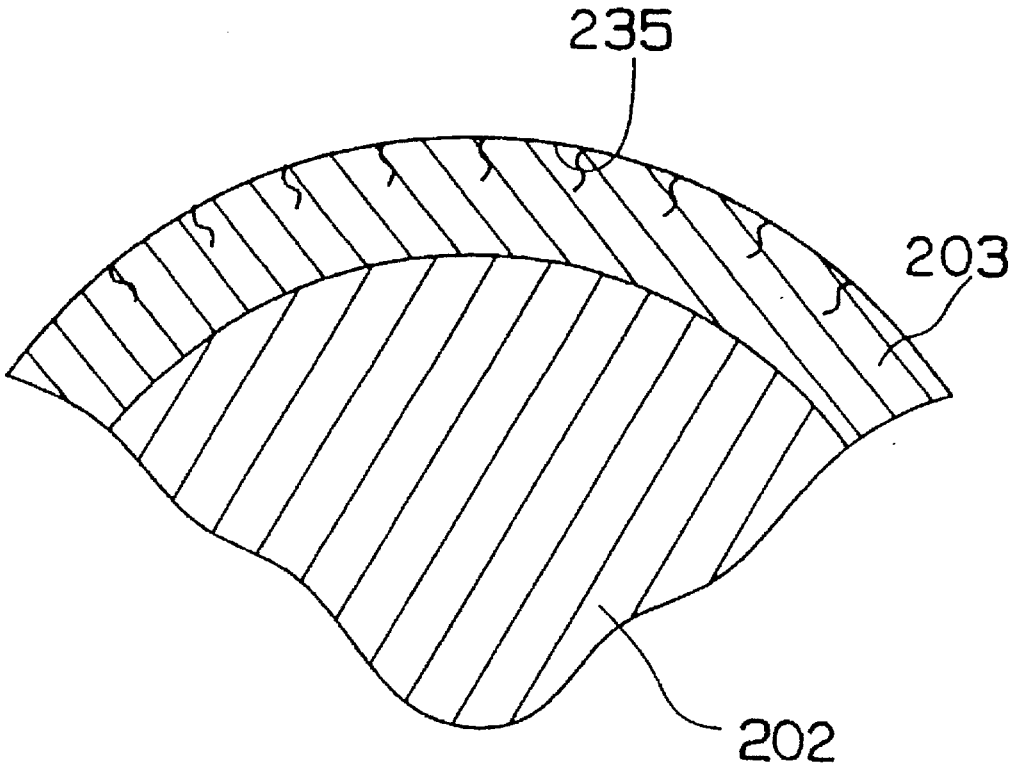
FIG. 11 is a cross sectional view of a center electrode indicating conditions of grain-boundary oxidation.

As shown in FIG. 11, oxidation advances along the grain boundary from the surface of the platinum-alloy ring in a spark plug exposed to the high-temperature environment of an engine combustion chamber. This grain-boundary oxidation 235 becomes the origin for the above cracking, and causes an exfoliation or dislodgement of the platinum ring. Accordingly, the relationship between the conditions of this grain-boundary oxidation 235 and the nickel addition amount was evaluated. As the evaluation method, a plug according to the present embodiment was mounted on the above-mentioned engine, which was then operated for 300 hours at a full load of 5,000 rpm.

Figure 12:
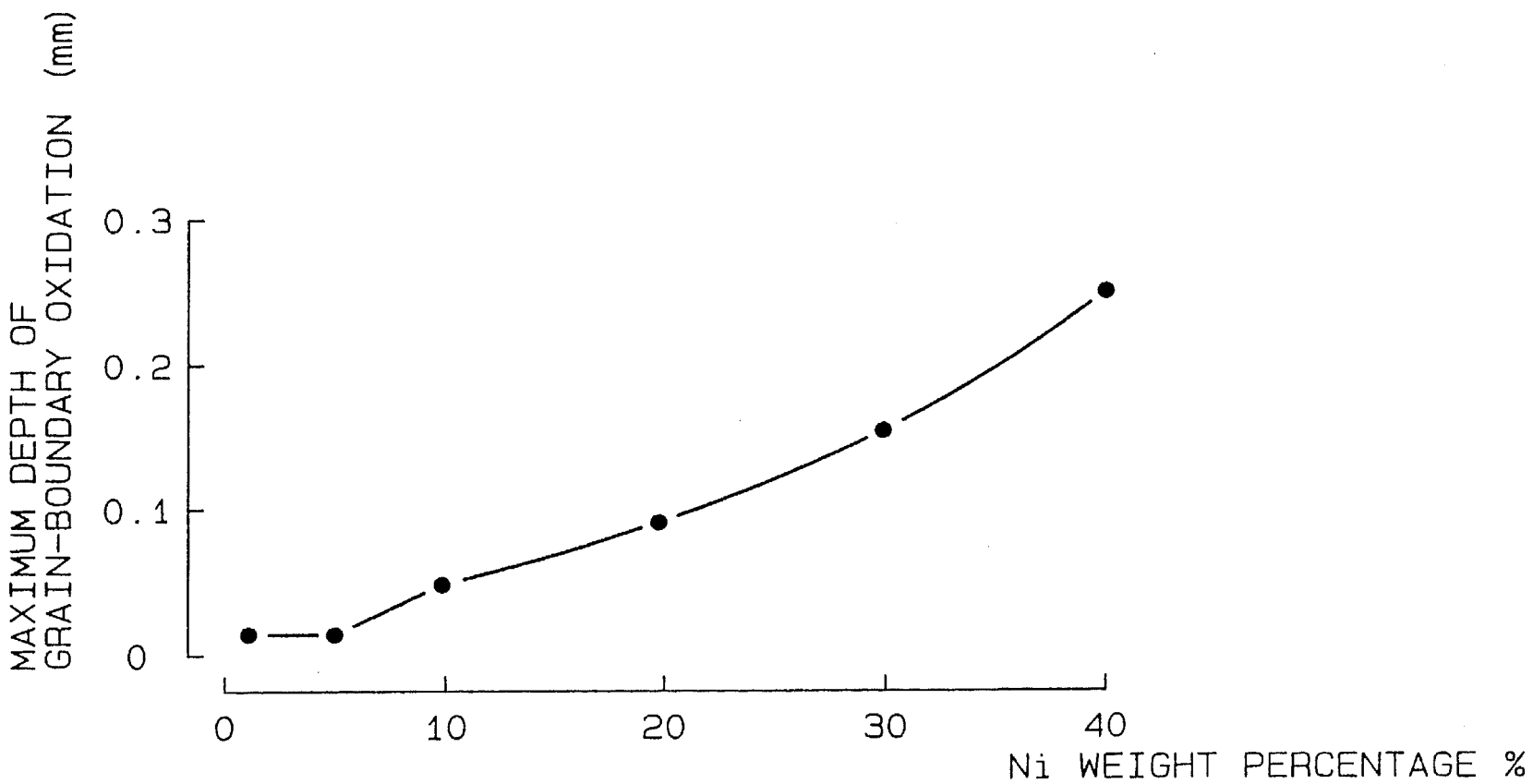
FIG. 12 is a characteristic diagram indicating conditions of grain-boundary oxidation with respect to nickel addition amount.

FIG. 12 is a characteristic diagram showing the conditions of grain-boundary oxidation with respect to the nickel addition amount.

The axis of ordinate indicates the maximum depth of grain-boundary oxidation, and the axis of abscissa indicates the weight percentage of the amount of nickel added.

As shown in FIG. 12, the depth of the grain-boundary oxidation increases in accordance with the increase in the nickel addition amount. This is because the resistance to oxidation of the platinum alloy at high temperature deteriorates in accordance with the increase in the nickel addition amount in the platinum alloy. Consequently, suppressing the depth of the grain-boundary oxidation to a low level is important in suppressing crack occurrence. As for practical use, however, it is sufficient that the nickel addition amount is 30% or less.

As described the above, in a spark plug according to the embodiment of the present invention, cracking does not occur in the platinum-alloy ring if the nickel addition amount is within the range of 10% to 30%. In addition, because a platinum-alloy ring is fixed to the large-diameter portion provided at the tip portion of the center electrode, it is more safe for the dislodgement of the platinum-alloy ring.

Next, modifications of the embodiment are described with reference to the drawings.

Figure 13:
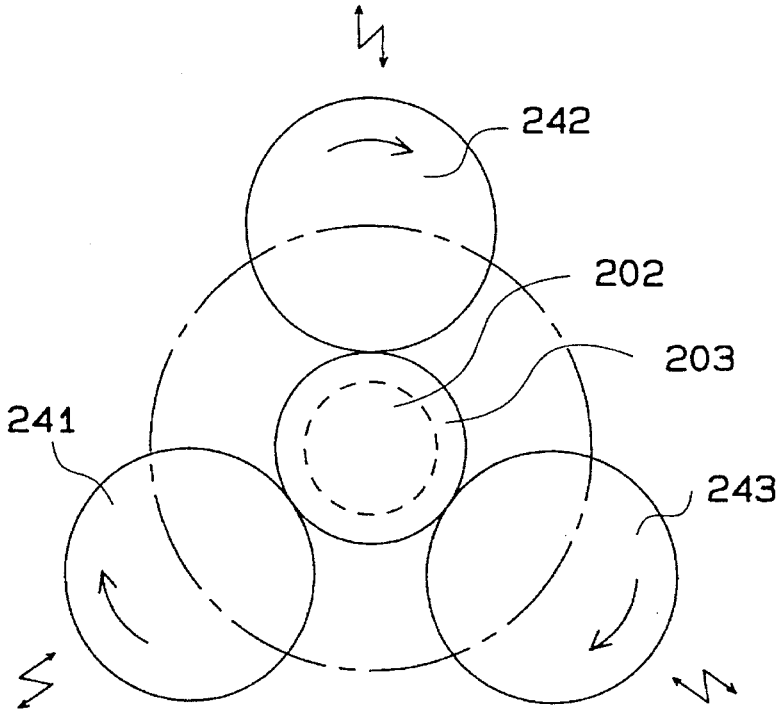
FIG. 13 is a situation diagram of rolling indicating a method of producing another embodiment.

First, in the above embodiment, a platinum-alloy ring 203 is adhered and fixed to a center shaft by swaging. It is not limited to the swaging, however, it is also applicable to reduce the diameter by the other process, for example, by rolling, as shown in FIG. 13. In machining of the rolling, rollers 241, 242, and 243 apply force radially to the surfaces of the center electrode 202 and the platinum-alloy ring 203 while rotating. Consequently, friction is low and the platinum-alloy ring 203 is formed into a substantially uniform thickness in the same way of the swaging.

Figure 14:
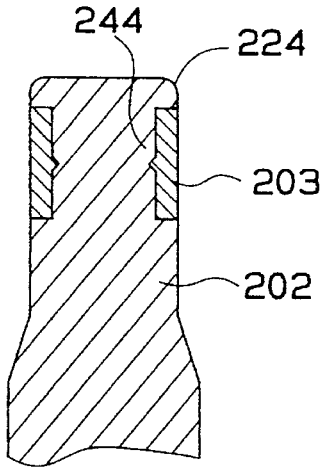
FIG. 14 is a cross sectional view showing a center electrode of another embodiment.

Furthermore, in FIG. 14, a radial groove 244 is provided on the center electrode 202 to make the fixing of the platinum-alloy ring 203 more reliable.

Figure 15A:
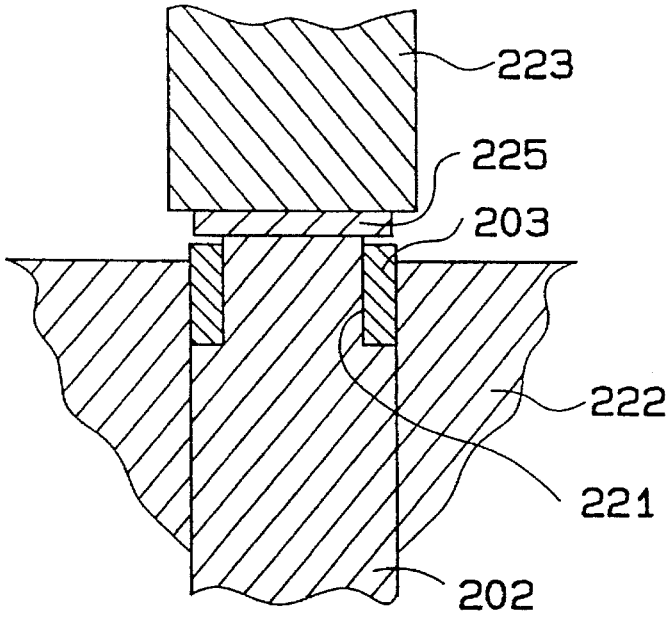
FIGS. 15A and B are cross sectional views for showing another method of producing the center electrode.
Figure 15B:
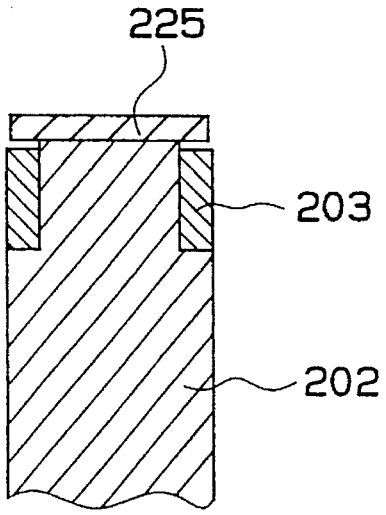

Moreover, as shown in FIG. 15A, a non-metal material 225 having a diameter larger than the inner diameter of the platinum-alloy ring 203 may be welded to the tip portion of the small-diameter portion 221 of the center electrode 202 while fixing with a jig 222 and compressing with a punch 226. The material 225 may then be formed into a large-diameter portion as shown in FIG. 15B, and thereafter the diameter may be reduced by swaging, rolling or the like.

Figure 16C:
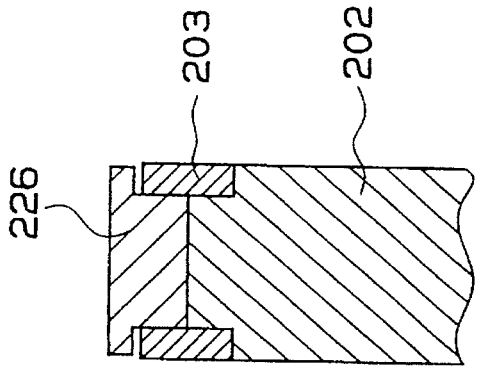
FIGS. 16A–C are cross sectional views for showing another method of producing the center electrode.
Figure 16B:
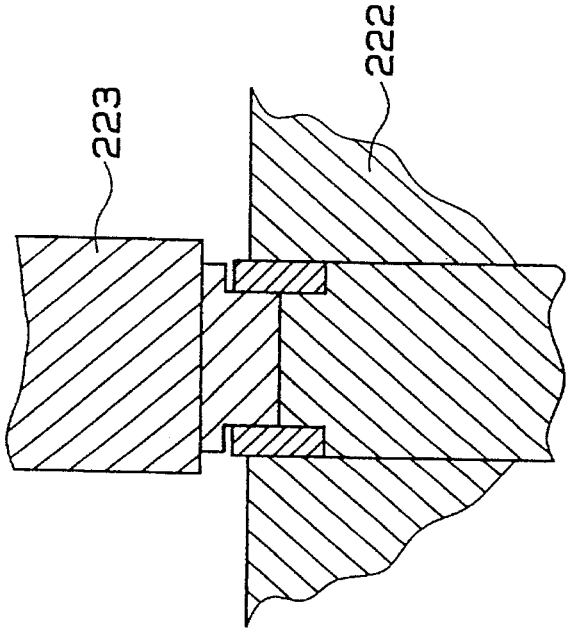
Figure 16A:
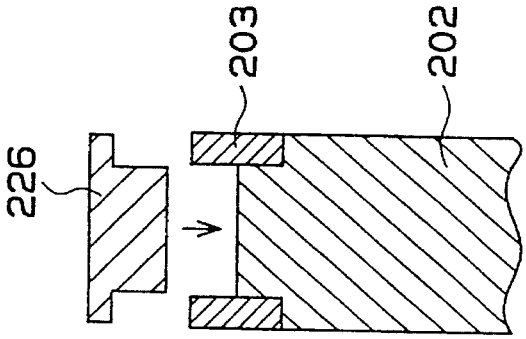

Additionally, as shown in FIG. 16A, a concave portion is formed by the center electrode 202 with a platinum-alloy ring 203 fitted to the center electrode 202, and a metal rivet 226 is fitted into the concave portion. At this time, as shown in FIG. 16B, the rivet 226 and the tip portion of the small-diameter portion 221 of the center electrode 202 is welded while fixing with a jig 222 and compressing with an punch.223. After the rivet 226 has been formed into a large-diameter portion as shown in FIG. 16C, the diameter is reduced by swaging, rolling or the like.

As described the above, a spark plug according to the present invention can be produced by a simple process including only machining independently a noble metal material of dissimilar metals and assembling this with a center electrode, thereby simplifying the production process as well as improving productivity.

Additionally, because the shape and dimensions of the noble metal material can be made so as to allow disposition of only the required quantity at the desired location, the degree of freedom in design can be expanded, and economy can also be made superior. Furthermore, the noble metal material of cylindrical shape or the like is installed so as to form a minute clearance, and consequently problems due to thermal stress are basically avoided, and excellent advantages with high durability are obtained.

What is claimed is:

1. A spark plug comprising:

a center electrode electrically insulated from a housing and having a small-diameter portion at a tip portion thereof which has a diameter smaller than that of a main body of said center electrode and composed of similar kinds of material as said center electrode;

a round-shaped material, which is formed into a cylindrical or a ring shape, composed of dissimilar metal material and fitted to said small-diameter portion of said center electrode so as to form a minute clearance between an inner surface of said round-shape material and an outer surface of said small-diameter portion of said center electrode, said round-shape material being composed of noble metal; and a ground electrode opposing to said center electrode so as to form a spark gap therebetween;

wherein said round-shape material is substantially longitudinally immovably fixed to said center electrode by a large diameter portion which is integrally formed on a tip portion of said center electrode such that said minute clearance is kept between said round-shape material and said center electrode.

2. A spark plug according to claim 1, wherein said round-shape material is comprised of a plurality of rings which are coaxially piled and formed into cylindrical shape.

3. A spark plug according to said claim 1, a convex portion or a concave portion is formed on an outer surface of said round-shape material.

4. A spark plug according to claim 1, wherein said round-shape material is a platinum-nickel type alloy.

5. A spark plug according to claim 4, wherein a nickel addition amount as said platinum-nickel type alloy is 10–30 weight percent.

6. A spark plug according to claim 1, wherein said round-shape material is composed of a platinum or a platinum alloy.

* * * * *